United States Patent [19]

Biancalani et al.

[11] Patent Number: 4,766,743

[45] Date of Patent: Aug. 30, 1988

[54] MACHINE FOR WASHING, BREAKING AND FULLING OF FABRICS, WITH PNEUMATIC DRAGGING

[75] Inventors: Fiorenzo Biancalani, Prato; Luigi Marcora, Vicchio, both of Italy

[73] Assignees: Officina Meccanica Biancalani & C. di Biancalani Fiorenzo & C.S.n.c.; Coramtex s.r.l., both of Italy

[21] Appl. No.: 900,360

[22] Filed: Aug. 25, 1986

[30] Foreign Application Priority Data

Aug. 27, 1985 [IT] Italy ..... 9483 A/85

[51] Int. Cl.[4] ..... D06B 5/08

[52] U.S. Cl. ..... 68/20; 68/177; 68/178

[58] Field of Search ..... 68/20, 177, 178

[56] References Cited

U.S. PATENT DOCUMENTS

| | | | |
|---|---|---|---|
| 3,685,325 | 8/1972 | Carpenter | 68/177 |
| 3,718,012 | 2/1973 | Vinas | 68/177 X |
| 3,952,558 | 4/1976 | Sandberg et al. | 68/177 |
| 4,020,658 | 5/1977 | Thies, Jr. | 68/177 X |
| 4,129,017 | 12/1978 | Green | 68/177 X |
| 4,392,365 | 7/1983 | Miyamoto et al. | 68/177 X |
| 4,545,221 | 10/1985 | Daniel et al. | 68/177 X |
| 4,570,404 | 2/1987 | Thompson | 68/178 |

*Primary Examiner*—Harvey C. Hornsby
*Assistant Examiner*—Frankie L. Stinson
*Attorney, Agent, or Firm*—McGlew & Tuttle

[57] ABSTRACT

A machine for treating fabrics, comprises—in combination with a wall against which the fabric is directed in order to strike against the wall and undergo the action thereof—: a duct for the dragging of the fabric; means to feed the fabric to said duct; means to convey a dragging air stream towards the outlet of said duct for the dragging of the fabric, in order to project it pneumatically against said wall, which is grid shaped; and possible means for pneumatic support.

10 Claims, 2 Drawing Sheets

MACHINE FOR WASHING, BREAKING AND FULLING OF FABRICS, WITH PNEUMATIC DRAGGING

FIELD AND BACKGROUND OF THE INVENTION

The invention relates to a machine that is of use for carrying out a treatment operation of the fabric, suitable to prepare said fabric for the finishing, and in particular to a machine that operates a washing, a bringing together of wefts and warp yarns of the fabric, and an at least partial fulling of the fabric; this machine is of use for the treatment of light fabrics and also of heavy fabrics and in particular for the treatment of relatively stiff fabrics.

Similar machines usually provide a wall, against which the fabric is pushed or thrown more or less violently, which fabric there undergoes the mentioned treatment before going back to a lower tank shaped part with water and cleansing agents wherefrom the fabric is taken again to be once more thrown towards the wall. The inclination of this wall can be adjustable, in respect to the throwing direction of the fabric.

SUMMARY AND OBJECT OF THE INVENTION

It is an object of the present invention, to carry out the above-mentioned treatment with greater efficiency and to obtain better results on the fabric, even with shorter times of treatment. These and other purposes and advantages will be evident to the experts through the reading of the text that follows.

Basically a machine according to the invention comprises— in combination with a wall towards which the fabric is directed in order to strike against said wall and undergo the action thereof—a duct for the dragging of the fabric; means to feed said fabric to said duct; and means to convey a dragging air stream towards the outlet of said duct for the dragging of the fabric, in order to project it pneumatically against said wall, that is grid shaped and angularly adjustable.

The direction of the projection of the fabric can be oriented towards the grid-shaped wall and upwards.

Said means of conveyance can have a portion forming an annular nozzle around the outlet of the fabric duct; a shaping of the dragging duct and a shaping of a pneumatic pipe surrounding said duct for the dragging of the fabric can cooperate to carry out the portion forming the nozzle; these two shapings can be axially adjustable to each other.

The means of feeding the fabric can include a couple of cylinders—per se known—through which the fabric is passed, with the speed of said cylinders being adjusted depending on the fabric requirement.

Means to push the air is provided (such as a fan) sucks it from the inside and/or the outside of the working casing, and is connected to said pipe upstream in respect to the shapings.

The machine can also comprise means for supporting the fabric, along the trajectory of the projection towards the grid. Said means can be pneumatic. They can include longitudinal ducts or canalizations at least in the lower area of the duct for the pneumatic projection, and/or a lower grid type structure to blow the air into the duct of pneumatic projection, and/or a second nozzle for the impulsion of the fabric.

The invention will be better understood by following the description and the enclosed drawings, that show a practical non restricting exemplification of the same invention.

Figure 1:
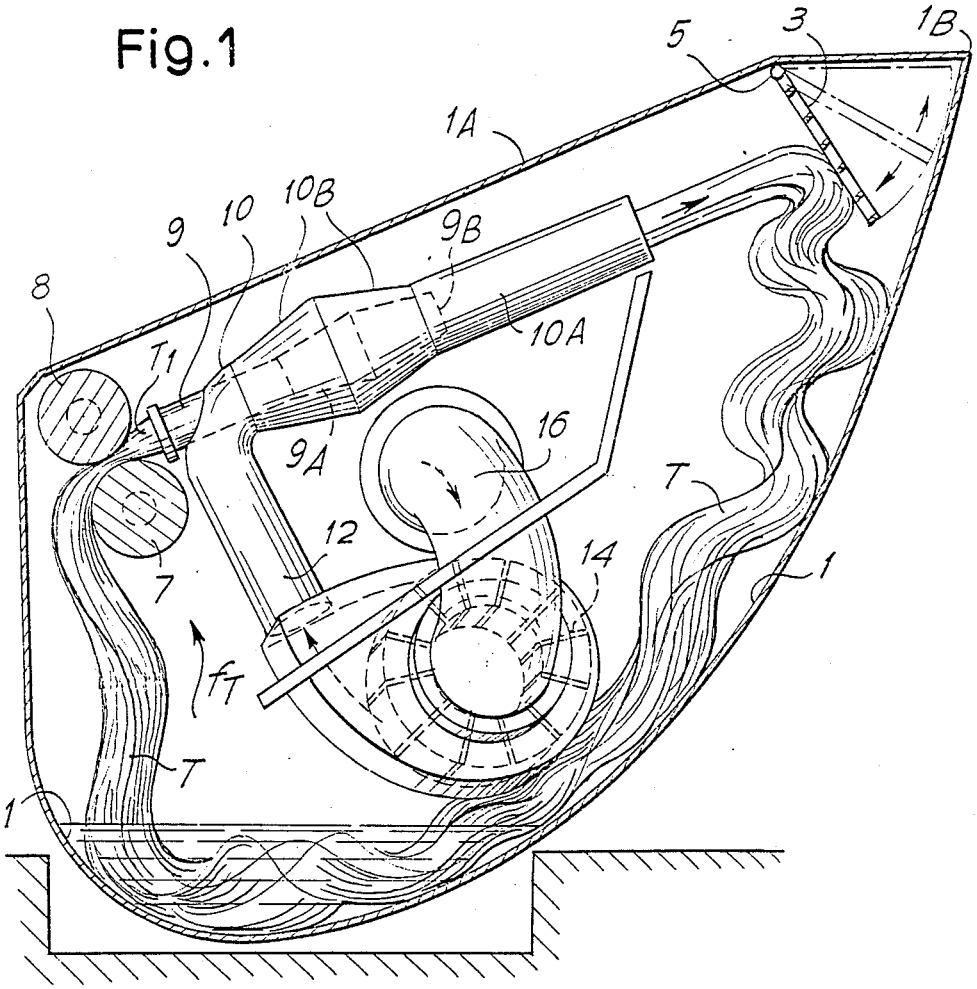
FIG. 1 shows a whole side cross section view.

Referring to the drawings, in particular, FIG. 1 shows a tank 1 defined by the bottom of a chamber which can be closed at the upper side 1A and shows suitable means for the entrance, with inspection and checking doors. The upper closing wall 1A slants upwards and towards the end 1B of the casing itself, and at this end 1B a grid type wall 3 is placed, articulated at 5 and thus so predisposed that its slant can be angularly adjusted in respect to the vertical line.

Corresponding and oriented towards the wall 3 an air jet is provided for the transportation of the fabric which is of particular use for dragging and projecting a fabric against the grid wall 3, being the fabric part of one piece (or several pieces) that is closed in such a way as to form a ring—simple or multiple—and is contained in the casing 1, 1A, the fabric being able to plunge into the liquid contained in the bottom of the tank 1, to be repeatedly recycled and projected against the grid wall 3. The fabric, indicated by T, is drawn upwards according to the arrow fT by an assembly of two dragging cylinders (or rollers) 7 and 8, one of them at least being driven into rotation at an adjustable speed and the other being urged towards the first one and possibly being driven into rotation at the same peripheral speed to drag the lifted fabric and feed it according to a trajectory T1 to a duct 9 for the pneumatic dragging of the fabric. This duct 9 shows an enlarged area 9A with a double truncated cone profile, which extends and ends with an outlet 9B adjacent to the truncated cone portion which is tapering towards said outlet. The axis of the duct 9, 9A, 9B is oriented towards the grid wall 3 and upwards. The duct 9, 9A, 9B is surrounded by a pipe 10 that is fed by compressed air through a duct 12 that is deviated in respect to the axis of the assembly 9, 10, and comes from a fan 14; the fan has a suction inlet 16 lying below the assembly 9, 10 inside the casing 1, 1A or—still inside the casing 1, 1A—above the assembly 9, 10, or sucks from the outside or partially from the inside and partially from the outside. The pipe 12, 10 extends beyond the outlet 9B with a portion 10A extending towards the grid 3 and upwards as shown in the drawing. The stream of air pushed by the fan 14 forms a means of pneumatic conveyance for the fabric that comes out from the outlet 9B of the duct 9, 9A, and is dragged by the stream of air coming from the duct 12 and that flows into the annular way between the duct 9 and the pipe 10, through the nozzle formed by the two shapings 9A and 10B, the latter being formed by the pipe 10, to carry out a truncated cone nozzle converging towards the outlet 9B and by this way suitable to act energetically on the fabric coming out from the same outlet 9B; the fabric is dragged by the air stream along the duct 10 and in particular along the end portion 10A of the duct, and is violently projected against the grid 3, where the action of treatment of the fabric takes place. The assembly of the cylinders 7 and 8 drags the fabric by lifting it according to the arrow fT and feeding it to the duct 9, 9A, 9B for the extent that is required by the effect of dragging caused by the air stream on the same fabric. The fabric can be fed for the required extent by the system of pneumatic dragging or for a lower extent, so that a certain tension is maintained in the projected fabric.

The fabric is violently treated by the grid 3 and then falls again towards the lower portion of the casing 1, where it gets soaked by the liquid contained in the bottom of this casing forming a tank; the fabric can also be invested with a liquid projected or distributed by fall, along the trajectory upstream the cylinders 7 and 8. The fabric drawn by the two cylinders 7 and 8 can be even partially squeezed by these two cylinders before being driven into the duct 9 by the effect of the pneumatic dragging.

The two shapings 9A and 10B can be adjusted in a mutual axis position, in order to vary the dragging effect by the air conveyed by the nozzle formed by these two shapings.

According to a development of the invention, devices are provided to assure a support, especially a pneumatic support of the fabric thrown towards the grid.

Figure 2:
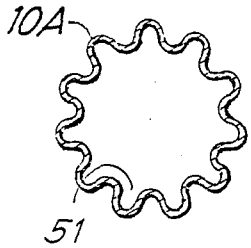
FIGS. 2 to 6 show transversal and longitudinal sections of some different ways of carrying out an effect of pneumatic support.
Figure 3:
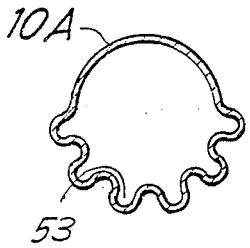
Figure 4:
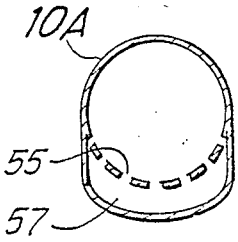
Figure 5:
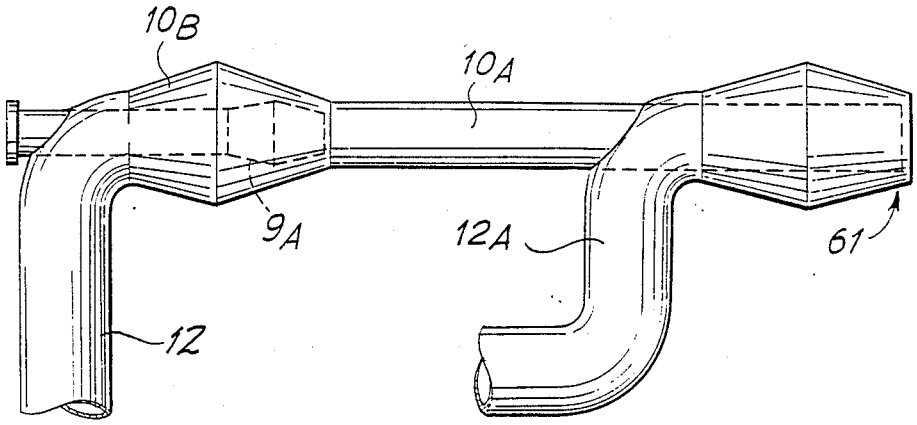
Figure 6:
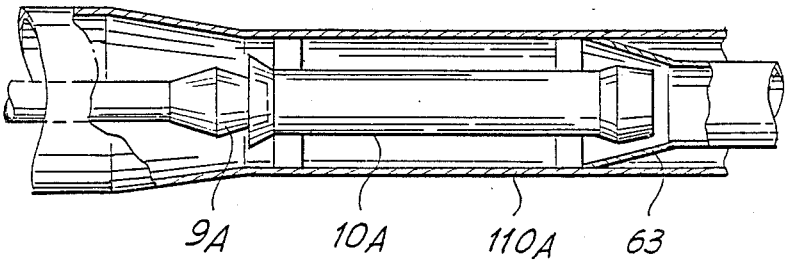

For this purpose, it is possible to provide for example the achievement of the portion 10A with undulations forming longitudinal channels 51, along the whole periphery of the section (FIG. 2) or channels 53 along the lower portion only (FIG. 3) or a grid system 55 (FIG. 4) especially longitudinal and with an underlying canalization 57 for the air that comes from the duct 12 or other source of air under pressure. As an alternative solution (FIG. 5) a second annular nozzle 61 can be provided at the end of the duct 10A, which is fed by a duct 12A. As another alternative solution, it can be provided to divide the air jet of the duct 12, thus realizing (FIG. 6) a jacket 110A around the duct 10A, to form a second nozzle 63.

The drawing shows only an exemplification, given as a practical demonstration of the invention that can vary in the forms and dispositions.

The second annular nozzle 61 can even be simply fed by air coming from the outside; in that case there is no need of the duct 12A.

While specific embodiments of the invention have been shown and described in detail to illustrate the application of the principles of the invention, it will be understood that the invention may be embodied otherwise without departing from such principles.

We claim:

1. A device for treating textile materials comprising: a housing defining a working space; a grid wall defining openings through which air may pass, said grid wall being connected to said wall; a venturi injector having an inner conduit defining a central suction area and an outer conduit surrounding said inner conduit, said venturi injector being positioned within said housing having jet opening directed at said grid wall substantially perpendicular thereto; pneumatic pump means having a suction inlet for drawing air into said pump means and a discharge opening for directing air under pressure; and, a conduit connecting said pneumatic pump means discharge with said outer conduit of said venturi injector, textile material fed into said central suction inner conduit being dragged by air from said outer conduit and being transported with an air stream into said grid wall, the air stream continuing to flow through said grid and said textile material striking said grid.

2. A device according to claim 1, wherein: the textile material is projected upwards into said grid wall.

3. A device according to claim 1, wherein: the inclination of said grid wall is adjustable.

4. A device according to claim 1, further comprising: means for feeding the textile material to said central suction inner conduit.

5. A device according to claim 4, wherein: said means to feed textile material includes first roller and a second roller, said first and second roller being rotatably mounted and cooperating to engage the textile material and feed the textile material to said inner conduit.

6. A device according to claim 4, wherein: said textile material forms a continuous rope passing through said means to feed textile material, through said venturi injector, impinges against said wall and passes through treating liquid positioned at a lower portion of said housing.

7. A device according to claim 1, wherein said outer conduit includes channels to assist in suction.

8. A device according to claim 7, further comprising: means for supporting said textile material as it passes through said venturi injector along a trajectory toward said grid wall.

9. A device according to claim 1, further comprising: a second venturi injector having at least a second outer conduit surrounding said outer conduit.

10. An apparatus for washing, breaking and fulling of fabrics, comprising: a housing defining an interior work space; a grid wall positioned within said housing, said grid wall forming opening through which air may pass; pneumatic venturi means positioned within said housing for dragging fabric from an inlet to an outlet, said venturi means including an inner central suction conduit and an outer high pressure air conductor; means to feed said fabric to an inlet of said venturi means; and, direction means for directing said dragged fabric and an air stream provided in said venturi means towards said grid wall so said air stream continues to flow through said grid and said fabric strikes said grid wall.

* * * * *